United States Patent [19]

Eskew et al.

[11] Patent Number: 5,025,522

[45] Date of Patent: Jun. 25, 1991

[54] BRIDGE DECK PANEL SUPPORT SYSTEM AND METHOD

[76] Inventors: Larry R. Eskew, 214 Echodale La., Knoxville, Tenn. 37920; Claude S. Simpson, 2001 Everheart Dr., NW., Cleveland, Tenn. 37311

[21] Appl. No.: 470,872

[22] Filed: Jan. 25, 1990

[51] Int. Cl.[5] ..... E01D 19/12

[52] U.S. Cl. ..... 14/73; 14/6; 52/167 R; 52/741

[58] Field of Search ..... 14/16.1, 17, 73, 6; 52/167 R, 334, 335, 338, 339, 326, 741

[56] References Cited

U.S. PATENT DOCUMENTS

| | | | |
|---|---|---|---|
| 794,246 | 7/1905 | O'Shea | 52/326 |
| 1,574,328 | 2/1926 | White | 52/335 |
| 1,892,225 | 12/1932 | Venzie | 52/335 |
| 2,945,248 | 7/1960 | Meagher et al. | 14/16.1 |
| 3,260,023 | 7/1966 | Nagin | 14/73 |
| 3,357,147 | 12/1967 | Lerner | 52/326 |
| 3,675,385 | 7/1972 | Chan | 52/741 |
| 3,918,230 | 11/1975 | Carroll | 52/335 X |
| 3,921,240 | 11/1975 | Fyfe | 14/16.1 |
| 3,970,026 | 7/1976 | Burton | 52/263 X |
| 4,077,171 | 3/1978 | Simpson et al. | 52/96 |
| 4,112,632 | 9/1978 | Simpson | 52/11 |
| 4,129,917 | 12/1978 | Sivachenko et al. | 14/73 |
| 4,295,310 | 10/1981 | McManus | 52/334 |
| 4,409,762 | 10/1983 | Raymond | 52/9 |
| 4,592,184 | 6/1986 | Person et al. | 52/334 |
| 4,597,233 | 7/1986 | Rongoe, Jr. | 52/334 |
| 4,604,841 | 8/1986 | Barnoff et al. | 14/17 X |
| 4,692,955 | 9/1987 | Kinkel | 14/17 |
| 4,709,435 | 12/1987 | Stemler et al. | 14/73 |
| 4,831,675 | 5/1989 | Nedelcu | 14/73 |
| 4,894,967 | 1/1990 | Morton | 52/334 |

*Primary Examiner*—Ramon S. Britts
*Assistant Examiner*—Gay Ann Spahn
*Attorney, Agent, or Firm*—Pitts and Brittian

[57] ABSTRACT

A bridge deck panel support system and method for supporting precast bridge deck panels on a bridge girder. The bridge deck panel support system (10) comprises at least one grade bar support member (24) which is anchored to the bridge girder (14) with a grade bar support anchor (16) so as to extend upwardly from the bridge girder (14). At least one grade bar (28) for supporting one or more deck panels (12) is secured to the upper portion (26) of the grade bar support member (24), the grade bar (28) being selectively spaced from the girder (14) such that a grout receiving space (32) is defined between the grade bar (28) and the girder (14). The grout receiving space (32) is filled with non-shrink grout (34) such that the load of the deck panels (12) is transferred from the grade bar (28) to the grout (34). The method of the present invention includes the steps of securing the grade bar support member (24) to the girder (14), securing the grade bar (28) to the grade bar support member (24), and substantially filling the grout receiving space (32) with non-shrink grout (34).

15 Claims, 5 Drawing Sheets

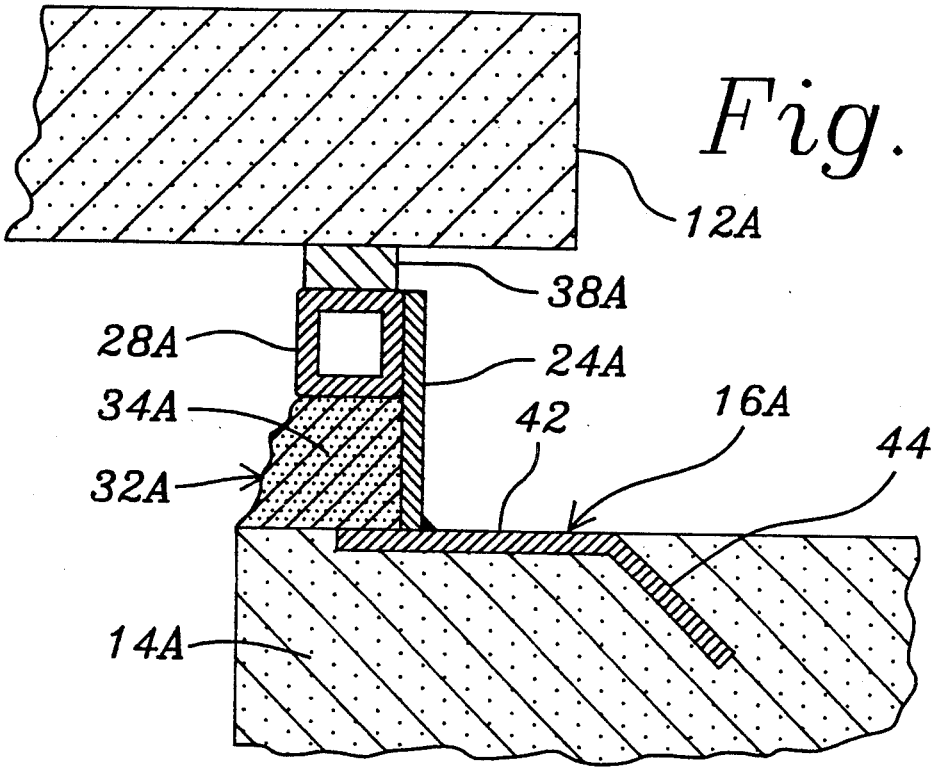
Fig. 4
Fig. 5
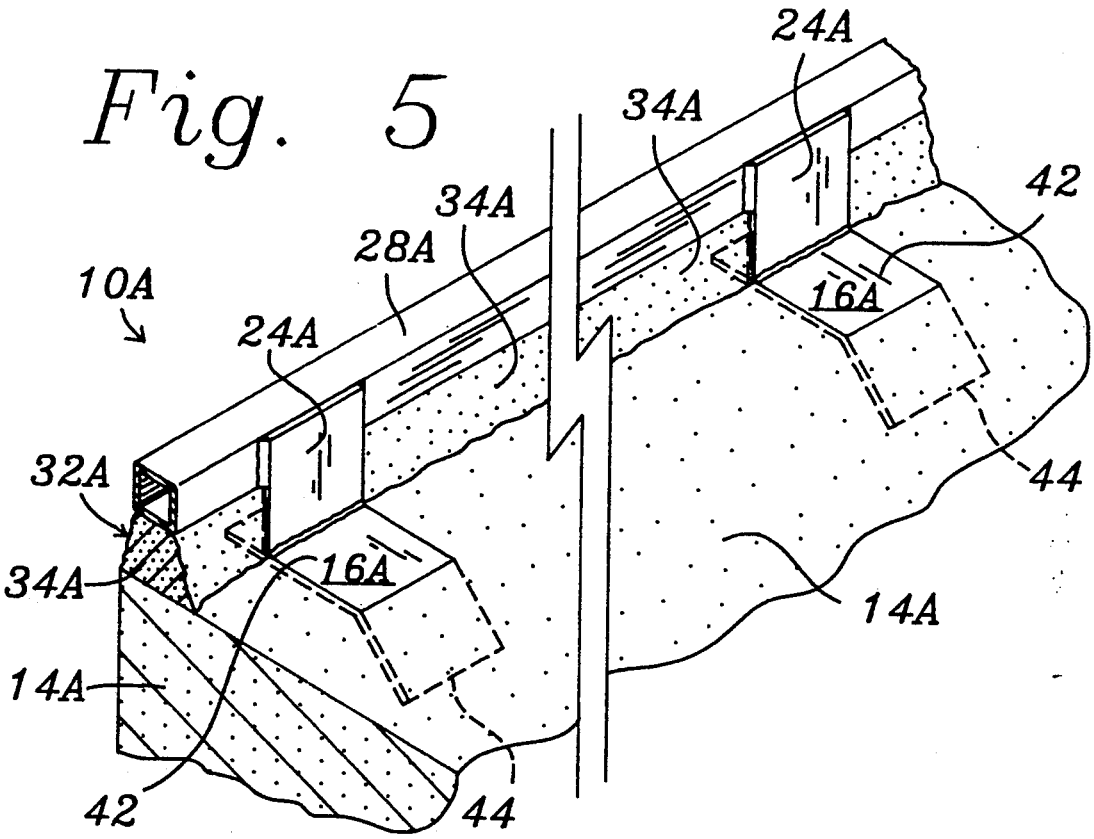

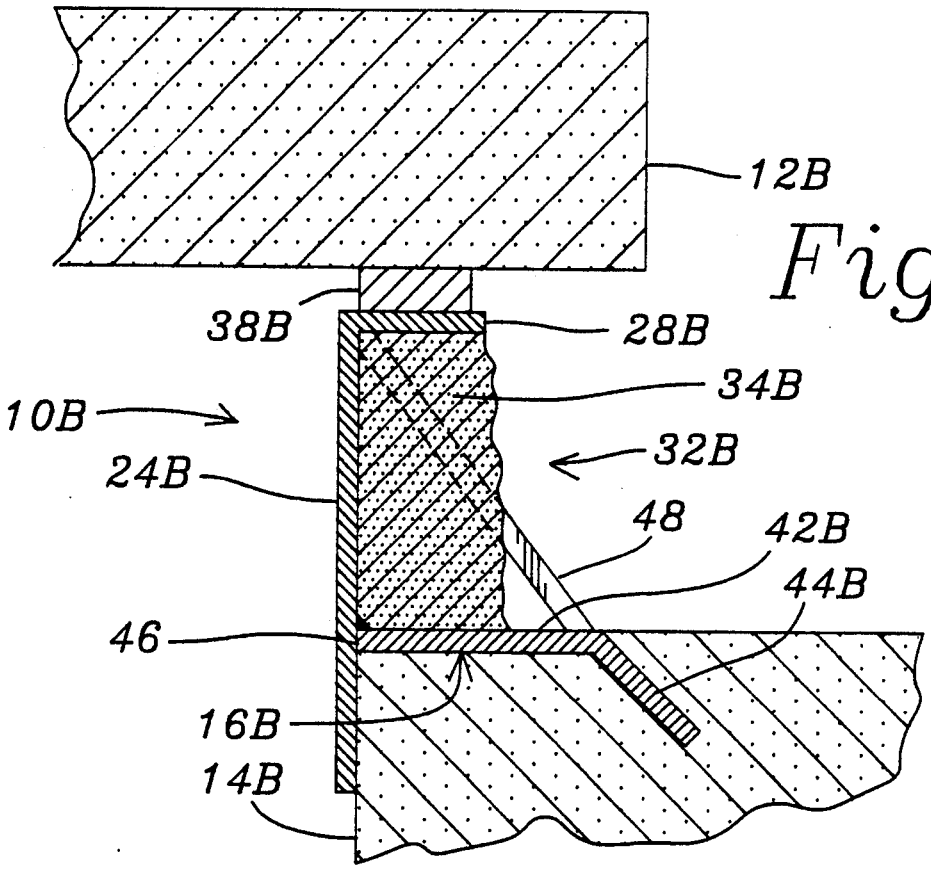
Fig. 6
Fig. 7
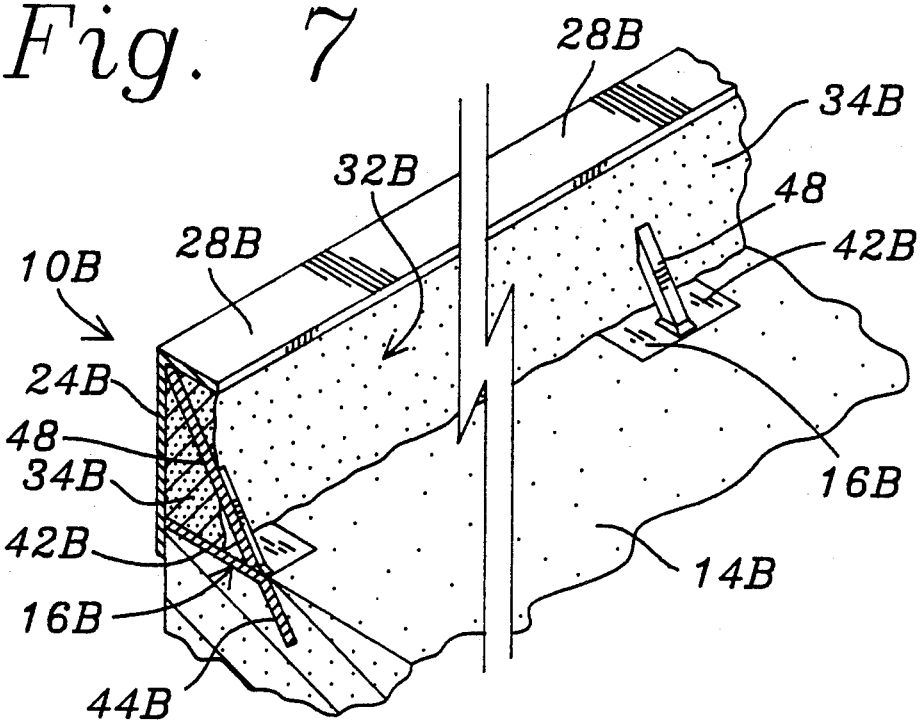

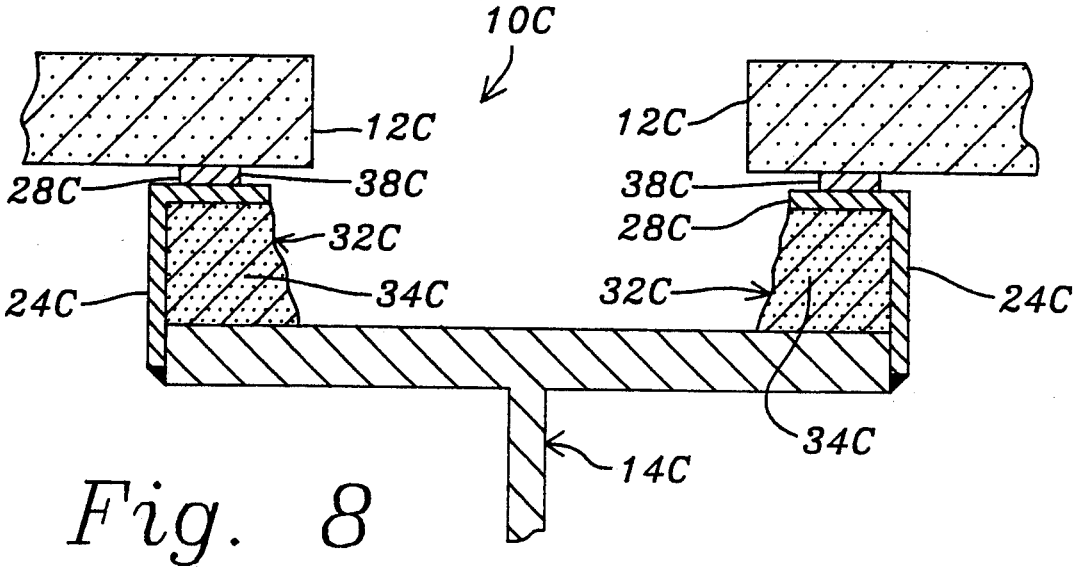
Fig. 8
Fig. 9
(Prior Art)
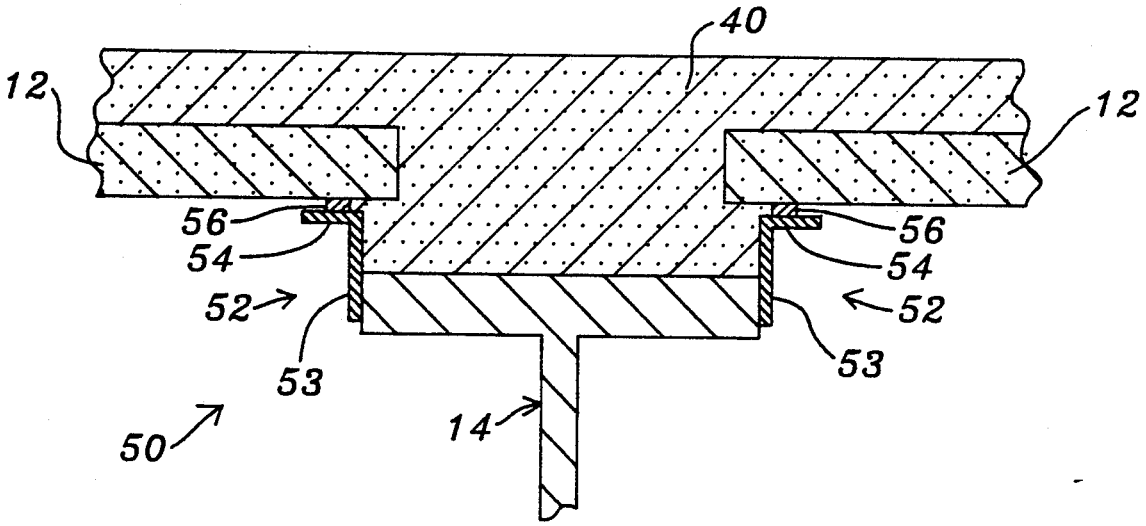

BRIDGE DECK PANEL SUPPORT SYSTEM AND METHOD

DESCRIPTION

1. Technical Field

This invention relates to a support system and method for supporting precast-prestressed concrete bridge deck panels on a bridge girder. In this particular invention, the system includes one or more grade bar support members mounted on the bridge girder, and a grade bar supported by the support members so as to define a grout receiving space between the grade bar and girder.

2. Background Art

Precast-prestressed concrete stay-in-place deck panels are currently the state-of-the-art for forming bridge decks between girders in bridge construction. The use of such deck panels has proven to be both economical and convenient, but the performance of the deck panel and structural integrity of the bridge structure is dependent on the proper mounting of the deck panels on the longitudinal bridge girders of the structure. In this regard, the system for supporting the deck panels must firmly support the deck panels to allow the proper pouring and curing of the field cast concrete topping which overlays the deck panels, and must afford flexibility in accurately setting the bottom deck grade required by the particular bridge configuration. A discussion of the use of precast-prestressed concrete bridge deck panels appears in "Precast Prestressed Concrete Bridge Deck Panels" prepared by PCI Committee on Bridges, *PCI Journal,* March–April 1987, and further information appears in "Tennessee Standard Precast Prestressed Bridge Deck Panels General Details 1986" prepared by the Department of Transportation, Bureau of Highways, State of Tennessee.

Heretofore, a typical system for supporting bridge deck panels and setting the bottom deck grade included one or more L-shaped supports secured to the girder and extending upwardly therefrom the required height for the desired bottom grade. The upper leg of the L-shaped supports extend outwardly to provide a horizontal grade bar for supporting the deck panel. Resultantly, the load of the deck panels is carried by the L-shaped supports leading to stability problems and restriction of the height at which the bottom grade can be set above the girder. Certain related bridge construction systems are disclosed in U.S. Pat. Nos.: 4,709,435; 4,409,762; 4,129,917; 4,112,632; 4,077,171; and 3,970,026.

Therefore, it is an object of the present invention to provide a bridge deck panel support system and method for firmly supporting precast-prestressed concrete deck panels on a bridge girder.

It is another object of the present invention to provide a bridge deck panel supporting system and method which allows flexibility in the setting and maintaining of the bottom deck grade required by a particular bridge structure.

Yet another object of the present invention is to provide a bridge deck panel support system which is convenient and economical to utilize.

DISCLOSURE OF THE INVENTION

Other objects and advantages will be accomplished by the present invention which provides a bridge deck panel support system and method for supporting precast bridge deck panels on a bridge support or girder. The support system comprises at least one grade support member which is anchored to the bridge girder with a grade bar support anchor so as to extend upwardly from the bridge girder. At least one grade bar for supporting one or more deck panels is secured to the upper portion of the grade bar support member, the grade bar being selectively spaced from the girder such that a grout receiving space is defined between the grade bar and the girder. The grout receiving space is filed with non-shrink grout such that the load of the deck panels is transferred from the grade bar to the grout, to be ultimately carried by the bridge girder. The method of the present invention generally comprises the steps of mounting the grade bar support member on the girder utilizing the grade bar support anchor, securing the grade bar to the upper portion of the grade bar support member, and substantially filling the grout receiving space with non-shrink grout.

BRIEF DESCRIPTION OF THE DRAWINGS

The above-mentioned features of the invention will become more clearly understood from the following detailed description of the invention read together with the drawings in which:

FIG. 4 illustrates an end view, in section, of an alternate embodiment of the bridge deck panel support system of the present invention;

FIG. 5 illustrates a perspective view, in section, of an alternate embodiment of the bridge deck panel support system of the present invention.

FIG. 6 illustrates a perspective view, in section, of an alternate embodiment of the bridge deck panel support system of the present invention.

FIG. 7 illustrates a perspective view, in section, of an alternate embodiment of the bridge deck panel support system of the present invention.

FIG. 8 illustrates an end elevation view, in section, of an alternate embodiment of the bridge deck panel support system of the present invention.

FIG. 9 illustrates an end elevation view, in section, of a prior art bridge deck panel support system.

BEST MODE FOR CARRYING OUT THE INVENTION

A bridge deck panel support system incorporating various features of the present invention is illustrated at 10 in the figures. As is set forth in greater detail below, the support system 10 is a forming system which allows the bearing grade of concrete stay-in-place bridge deck panels 12 to be accurately set above bridge supports and acts as a form for a bed of non-shrink grout. It will be recognized by those skilled in the art that the bridge supports referenced herein can include steel girders, precast I-beams, box beams, bulb tree girders or other bridge supports.

Figure 1:
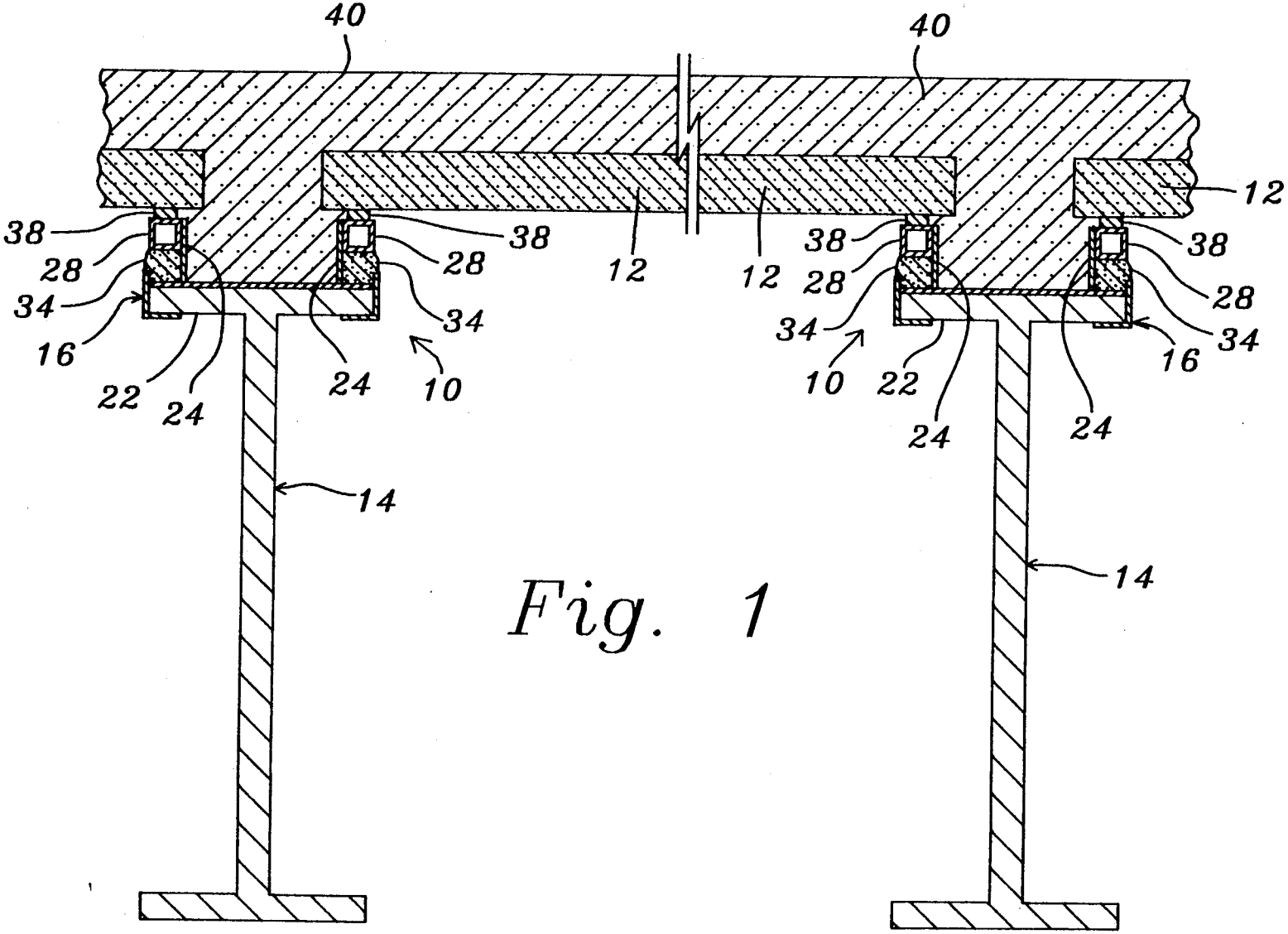
FIG. 1 illustrates a partial end elevation view, in section, of a bridge structure incorporating a bridge deck panel support system of the present invention.
Figure 2:
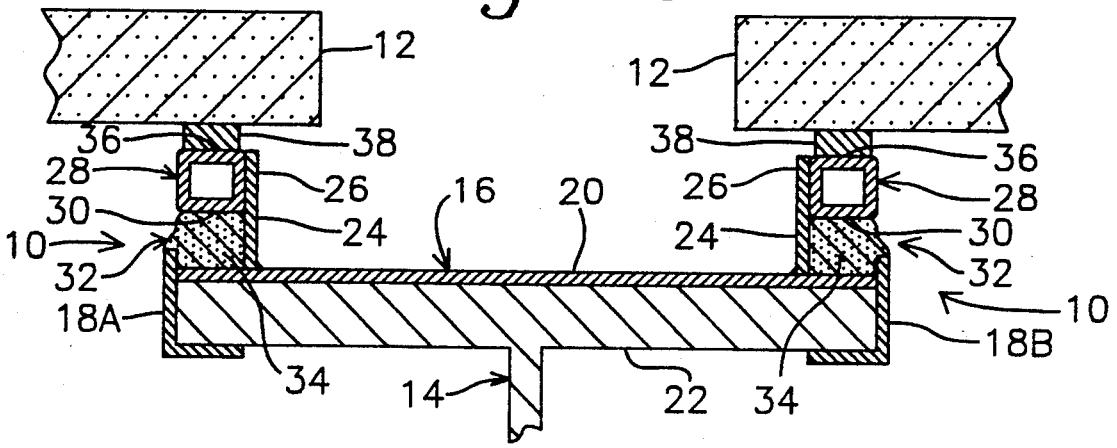
FIG. 2 illustrates an end elevation view, in section, of a bridge deck panel support system of the present invention.
Figure 3:
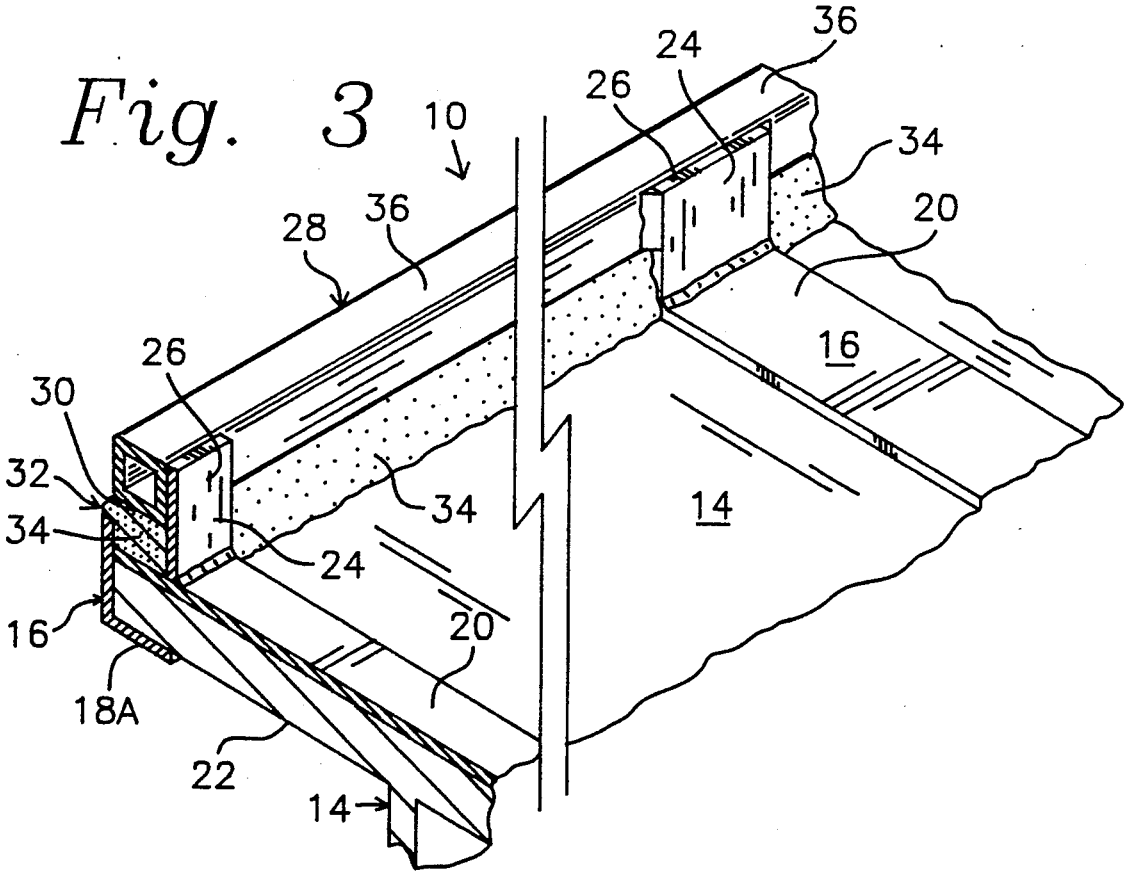
FIG. 3 illustrates a perspective view, in section, of a bridge deck panel support system of the present invention.

In FIGS. 1–3 one preferred embodiment of the support system 10 is illustrated, this embodiment being particularly suited for supporting bridge deck panels on steel girders 14. The system comprises a plurality of grade bar support anchors 16 which engage the girder 14, the anchors 16 being selectively spaced along the girder 14. In this preferred embodiment, the anchors 16 include a pair of oppositely disposed L-shaped members 18A and 18B, and an upper strap member 20 which are secured together, as by welding, to form a C-shaped clamp which engages the head portion 22 of the girder 14. The system !0 also comprises a plurality of grade bar supports 24 which are secured to, and extend upwardly from the anchors 16, the grade bar support members 24 defining upper portions 26. In the figures the grade bar support members 24 are aligned along both sides of the head portion 22 of the girder 14, but it will be recognized that for some applications a single alignment of support members 4 can be utilized.

The system 10 further comprises one or more grade bars 28 secured, as by welding, to the upper portions 26 of the grade bar support members 24, such that the lower surface 30 of the grade bar 28 is selectively spaced from the girder 14. Resultantly, a grout receiving space 32 is defined between the grade bar 28 and the girder 14, this space 32 being filed with a non-shrink grout 34. Further, the grade bar 28 defines an upper surface 36 upon which is positioned a bearing seal strip 38 which is continuous with the grade bar 28.

With the support system ? 0 constructed as set forth above, the edges of the deck panels 12 are supported on the grade bar 28 with the bearing strip 38 interposed therebetween. However, rather than the load being carried by the grade bar 28 and the grade bar support members 24, the grout 34 serves to transfer the load from the grade bar 28 to the girder, thereby providing a stronger, more durable supporting structure for the deck panels 12 and allowing the bottom grade to be set at greater heights than with conventional systems. Of course, once the deck panels 12 are in place on the support system 10, a field cast concrete overlay 40 is placed over the deck panels 12 and fills the spaces between the panels 12 and above the girder 14 as illustrated in FIG. 1.

It will be recognized by those skilled in the art that the anchors 16, support members 24 and the grade bars 28 are preferably fabricated of steel or other strong, durable metal, and are preferably secured together by welding. Further, whereas the grade bars 28 are illustrated as being supported by a plurality of support members 24, it will be appreciated that the support member 24 can be continuous with the associated grade bar 28 if desired.

Referring now to FIGS. 4 and 5, an alternate embodiment of the deck panel support system of the present invention is illustrated at 10A. For convenience, the components of the support system 10A which are common to the system 10 discussed above are indicated by common numerical references together with the alphabetic character "A". In the support system 10A, the anchors 16A have been adapted for being anchored in precast concrete bridge girders 14A. In this regard, each of the anchors 16A defines a portion which is embedded in the concrete of the girder 14A in order to anchor the system 10A to the girder 14A. More specifically, in the preferred embodiment the anchor 16A includes a forward portion 42 which engages and supports the grade bar support member 24A and a rearward portion 44 which angles downwardly from the forward portion 42 and into the girder 14A It will be noted that in the preferred embodiment the portion 42 is recessed into the concrete of the girder 14A to further insure stability. Of course, the anchors 16A must be put in place when the girder 14A is cast, but the support members 24A and the grade bar 28A can be secured in place at a later time.

In FIGS. 6 and 7 a further embodiment of the deck panel support system of the present invention is illustrated at 10B. For convenience, the components of the support system 10B which are common to the systems !0 and 10A discussed above are indicated by common numerical references together with the alphabetic character "B". The support system 10B is particularly well suited for uses where the grade bar is required to be an above normal height above the girder. In this regard, the anchor 16B of the system 10B defines essentially the same configuration as the anchor 16A. However, the support member 24B is secured to the forward edge 46 of the anchor 16B and extends below the upper level of the girder 14B in facial abutment with the side of the girder 14B. Further, operatively associated with each anchor 16B is at least one brace member 48 which extends from a point proximate the junction of the portions 42B and 44B to a point proximate the junction of the support member 24B and the grade bar 28B. Thus, the brace member 48 extends into the grout receiving space 32B such that it not only serves to stabilize the support member 24B and grade bar 28B, but also serves as a grout reinforcing means. With respect to the support system 10B, it will be noted that the grade bar 28B defines a flat, elongated member integrally formed with the support member 24B, rather than the rectilinear tubing of the grade bars 28 and 28A. However, it will be recognized that either grade bar configuration can be used in the various embodiments of the system of the present invention.

Yet another alternate embodiment of the present invention is illustrated at 10C in FIG. 8. For convenience, the components of the support system 10C which are common to the systems 10, 10A and 10B are indicated by common numerical references together with the alphabetic character "C". It will be noted that in the system 10C, the support members 24C are secured, as by welding, directly to the girder 14C. Whereas certain legal jurisdictions prohibit the welding of deck panel support structures directly to the bridge girder, and whereas such construction may be less desirable than other embodiments of the present invention, it is contemplated that the embodiment of the system 10C can be advantageously utilized for certain applications.

In light of the above, it will be recognized that the support system of the present invention and the method by which it is employed provide an improved means for supporting precast bridge deck panels on a bridge support. The advantages of the system can be readily seen by comparing the conventional deck panel support system illustrated at 50 in FIG. 9. The system 50 is typical of the prior art and comprises a pair of L-shaped angle supports 52 each including an upright portion 53 secured to the girder 14 and an outwardly disposed grade bar 54. A bearing 56 is mounted on the grade bar 54, with deck panels 12 resting upon the bearing seal 56. As will be recognized by those skilled in the art, such construction requires that the full load of the deck panels be carried by the angle supports 52. Resultantly, stability problems can arise with such construction, particularly where the grade bar must be disposed at a substantial height above the girder to achieve the required bottom grade. By comparison, in the system of the present invention, the load is shifted to the non-shrink grout which is, in turn, supported on the girder resulting in a much more stable support system.

While a preferred embodiment has been shown and described, it will be understood that there is no intent to limit the invention to such disclosure, but rather it is intended to cover all modifications and alternate constructions falling within the spirit and scope of the invention as defined in the appended claims.

We claim:

1. A support system for supporting precast bridge deck panels on a bridge support, said system comprising:

at least one grade bar support member secured to, and extending upwardly from, said bridge support, said grade bar support member defining an upper portion; and at least one grade bar for supporting at least one said deck panel, said grade bar defining an upper support surface for supporting said deck panel and a lower surface, said grade bar being secured to said upper portion of said grade bar support member such that a grout receiving space is defined between said lower surface of said grade bar and said bridge support for receiving non-shrink grout.

2. The support system of claim 1 wherein said system also comprises at least one grade bar support anchor operatively associated with said grade bar support member for securing said grade bar support member to said bridge support.

3. The support system of claim 1 wherein said system further comprises non-shrink grout for being received in said grout receiving space.

4. The support system of claim 2 wherein said system comprises a plurality of said grade bar support members selectively spaced along said bridge support.

5. The support system of claim 2 wherein said bridge support includes an I-shaped girder having a head portion, and wherein said anchor includes a pair of oppositely disposed L-shaped members and an upper strap member secured at its opposite ends to said L-shaped members so as to define a C-shaped clamp for engaging said head portion of said girder.

6. The support system of claim 2 wherein said bridge support is fabricated from concrete, and wherein said anchor comprises a substantially horizontal forward portion to which is secured said grade bar support member and a downwardly angled rearward portion for being embedded in said concrete of said bridge support.

7. The support system of claim 6 wherein said anchor defines a forward edge for engaging said grade bar support member and wherein said grade bar support member extends below the upper surface of said bridge support in facial abutment with a side surface of said bridge support.

8. The support system of claim 7 wherein said system further comprises a brace member extending between a point proximate the junction of said forward and rearward portions of said anchor and a point proximate the junction of said grade bar support member and said grade bar such that at least a portion of said brace member extends into said grout receiving space.

9. The support system of claim 1 wherein said system further comprises a bearing seal strip mounted on said upper surface of said grade bar for being interposed between said grade bar and said deck panels.

10. A support system for supporting precast bridge deck panels on a bridge support, said system comprising:

a plurality of grade bar support members for being secured to said bridge support so as to extend upwardly therefrom, each said grade bar support member defining an upper portion;

at least one grade bar for supporting at least one said deck panel, said grade bar defining an upper surface and a lower surface, said grade bar being secured to said upper portions of said grade bar support members such that a grout receiving space is defined between said lower surface of said grade bar and said bridge support;

non-shrink grout received in and substantially filling said grout receiving space; and a bearing seal strip for being received on said upper surface of said grade bar so as to be interposed between said grade bar and said deck panel as said deck panel is supported on said grade bar.

11. A method for supporting precast bridge deck panels on a bridge support, said method comprising the steps of: mounting at least one grade bar support member on said bridge support such that said grade bar support member extends upwardly from said bridge support, said grade bar support member defining an upper portion;

securing a grade bar to said upper portion of said grade bar support member such that said grade bar is selectively spaced from said bridge support and such that a grout receiving space is defined between said grade bar and said bridge support;

substantially filling said grout receiving space with a non-shrink grout; and mounting said precast bridge deck panel on said grade bar.

12. The method of claim 1 wherein said step of mounting said deck panel includes the placing of a bearing seal strip on the upper surface of said grade bar and placing said deck panel thereon.

13. The method of claim 11 wherein said step of mounting said grade bar support member on said bridge support includes securing at least one grade bar support anchor to said bridge support and securing said grade bar support member to said anchor.

14. The method of claim 13 wherein said bridge support comprises an I-shaped girder having a head portion and said anchor defines a pair of oppositely disposed L-shaped members and a strap member having opposite end portions and wherein said step of mounting said grade bar support member on said bridge support further includes the securing of said L-shaped members to said opposite end portions of said strap member so as to provide a C-shaped clamp member for engaging said head portion of said bridge support.

15. The method of claim 13 wherein said bridge support is fabricated of concrete, and said anchor comprises a substantially horizontal forward portion and a downwardly angled rearward portion, and wherein said step of mounting said grade bar support member on said bridge support includes embedding said rearward portion of said anchor in said concrete of said bridge support and securing said grade bar support member to said forward portion of said anchor.

* * * * *